US010717098B2

(12) United States Patent
Delmon et al.

(10) Patent No.: US 10,717,098 B2
(45) Date of Patent: Jul. 21, 2020

(54) DEVICE FOR PACKAGING AND DISPENSING A FLUID PRODUCT IN METERED QUANTITIES

(71) Applicant: QUALIPAC, Clichy (FR)

(72) Inventors: Marc Delmon, Ytrac (FR); Gérald Martines, Paris (FR)

(73) Assignee: QUALIPAC, Clichy (FR)

( * ) Notice: Subject to any disclaimer, the term of this patent is extended or adjusted under 35 U.S.C. 154(b) by 8 days.

(21) Appl. No.: 15/767,005

(22) PCT Filed: Oct. 6, 2016

(86) PCT No.: PCT/FR2016/052571

§ 371 (c)(1),
(2) Date: Apr. 9, 2018

(87) PCT Pub. No.: WO2017/060631

PCT Pub. Date: Apr. 13, 2017

(65) Prior Publication Data

US 2019/0060929 A1 Feb. 28, 2019

(30) Foreign Application Priority Data

Oct. 8, 2015 (FR) ..... 15 59595

(51) Int. Cl.
*B05B 11/00* (2006.01)

(52) U.S. Cl.
CPC ..... *B05B 11/0013* (2013.01); *B05B 11/0038* (2018.08); *B05B 11/00412* (2018.08);
(Continued)

(58) Field of Classification Search
CPC ..... B05B 11/0013; B05B 11/0038; B05B 11/00412; B05B 11/00416; B05B 11/3001; B05B 11/3047
(Continued)

(56) References Cited

U.S. PATENT DOCUMENTS 6,309,124 B1 * 10/2001 Gueret ..... A45D 34/045 401/123
7,186,045 B2 * 3/2007 Gueret ..... A45D 34/04 401/130

(Continued)

FOREIGN PATENT DOCUMENTS

EP 2 153 908 A1 2/2010
FR 2 833 577 A1 6/2003

OTHER PUBLICATIONS

International Search Report, dated Jan. 4, 2017, from corresponding PCT/FR2016/052571 application.

*Primary Examiner* — Paul R Durand
*Assistant Examiner* — Andrew P Bainbridge
(74) *Attorney, Agent, or Firm* — Young & Thompson

(57) ABSTRACT

A device for packaging and dispensing a generally fluid product includes a dispensing head placed on top of an external body into which is inserted an internal container that forms a reservoir and is suitable for rigid attachment to a metering assembly of the head. The metering assembly, of the airless type, includes a metering pump that is surrounded and supported by a closing element in direct contact with the upper end of the container in a leaktight annular connection area. A ring which surrounds the connection area covers an internal peripheral volume defined between the body and the container. A wall that is movable towards the pump inlet provides a leaktight separation and maintains an identical pressure between the product in the reservoir and the air in the peripheral volume.

24 Claims, 8 Drawing Sheets

(52) U.S. Cl.
CPC .... *B05B 11/00416* (2018.08); *B05B 11/3001* (2013.01); *B05B 11/3047* (2013.01)

(58) Field of Classification Search
USPC ..... 222/386
See application file for complete search history.

(56) References Cited

U.S. PATENT DOCUMENTS

| | | | | |
|---|---|---|---|---|
| 7,891,522 | B2 | 2/2011 | Law et al. | |
| 8,499,970 | B2 * | 8/2013 | Yoo | A45D 34/00 222/41 |
| 10,065,203 | B2 * | 9/2018 | Moretti | B65D 77/06 |
| 2001/0025863 | A1 * | 10/2001 | Lorscheidt | B05B 11/0005 222/256 |
| 2005/0029291 | A1 | 2/2005 | Arghyris et al. | |
| 2007/0164049 | A1 * | 7/2007 | Bonney | B05B 11/3056 222/162 |
| 2012/0067924 | A1 | 5/2012 | Deans | |
| 2013/0140332 | A1 | 6/2013 | Csaszar | |
| 2014/0346196 | A1 * | 11/2014 | Byeon | B05B 11/00416 222/256 |
| 2016/0286932 | A1 * | 10/2016 | Lee | A45D 34/00 |
| 2016/0318055 | A1 * | 11/2016 | Scott | B05B 11/3084 |

* cited by examiner

DEVICE FOR PACKAGING AND DISPENSING A FLUID PRODUCT IN METERED QUANTITIES

BACKGROUND OF THE INVENTION

The present invention relates to the technical field of packaging, more specifically to the packaging and dispensing of a liquid or viscous product intended to be stored in a sealed manner and to be dispensed in unit doses by means of a dispenser assembly.

The invention more particularly relates to a device for packaging and dispensing a fluid product, and which comprises a container for containing the product and an airless metering nozzle for dispensing the product.

The device for packaging and dispensing a product, generally fluid, typically comprises a metering assembly adapted to dispense a dose of the product. Concerning the product architecture, the device is divided into two subportions:

- the reservoir portion which comprises a container (defining the reservoir) provided with an upper filling opening, typically only one;
- the head which is assembled onto the reservoir portion and incorporates the metering assembly.

To enable pharmaceutical or cosmetic applications, the delivered dose must be constant and accurate. In order to avoid pumping a different volume of the desired dose (for example cavitation), the metering assembly typically comprises a metering pump without air intake (conventionally designated by the expression "airless") associated with a plugging element which is part of a stationary portion of the metering assembly (the plugging element making it possible to position the metering pump inlet in the reservoir), while a movable actuating portion allows dispensing the fluid.

Description of the Related Art

A device for packaging and dispensing fluid of the aforementioned type is known from US patent 2013/0140332, which describes a mode of pumping involving a piston which slides within the container (requiring a dynamic seal on the lower side of the reservoir). The reservoir portion comprises the container, the associated piston, and a connection interface of the container for connecting the dispensing portion of the head to the reservoir of the lower portion (after filling), which requires a static seal. When the head is in a mounted state, the inlet of the metering pump extends to a tubular end of the reservoir that is opposite to the bottom of the reservoir portion.

The implementation of these different functions with a sufficient level of performance dictates the shape of the product.

This type of this connection interface thus has the disadvantage of limiting the options for decorative packaging (lack of versatility), in particular when the container defines the outer body of the reservoir portion (lower portion). The shape must necessarily be cylindrical to ensure proper sealing in the contact between the piston and the inner face of the container (dynamic sealing). This is to avoid:

- altering the properties of the formulation by selective evaporation of some of its compounds, from the inside of the pack to the outside,
- oxidation of certain components of the formulation that would be sensitive to contact with oxygen that could enter from the outside to the inside of the pack.

In the luxury sector, in the field of cosmetics or other fields, it is difficult to be satisfied with a shape that is essentially dictated by functional performance requirements.

In an alternative embodiment, US patent 2013/0140332 thus shows a decorative packaging defined by a hollow body which surrounds the container, enclosing it at a neck of the container (see FIGS. 6A and 6B of that document with a threaded neck). However, in this case the filling of the container is not very suitable for mass production, particularly when the liquid product is viscous (for example the product can correspond to a wide range, from 1000 centipoise (cP) to 40,000 cP). Indeed, it has been observed that the narrow opening due to the presence of a neck has the effect of slowing the filling rate. In addition, it is necessary to provide a format for the exterior body that is highly dependent on the container used.

The use of a threaded neck for sealing has the further disadvantage that the system is easily disassembled. The performance demanded of dispensing devices in the field of cosmetics tends to require preserving the integrity of the dispensing system (integrity of the airless system). It is therefore preferable to be able to achieve a static seal without using a removable attachment system, so that the device cannot be disassembled once packaged (including by the end user).

Moreover, it has been found that static sealing with the use of a gasket can cause problems when an elastomer gasket is interposed between the neck and the pump. This type of gasket is provided for example in the packaging device described in document FR 2,833,577 and its U.S. counterpart US 2005029291. There is then the risk of migration into the formulation of the plasticizers present in the gasket (toxicity hazard). The use of a vulcanized rubber gasket has the disadvantage of a characteristic odor which can give the formulation an unpleasant odor. And if the gasket is crafted from a foam material, these have been found to change shape over time and lose the seal.

BRIEF DESCRIPTION OF THE INVENTION

There is a need for better integration of an airless metering assembly which can satisfy many technical requirements that are desirable for such a system (static sealing, dynamic sealing and protection of the product circuit, ability to dispense a wide range of viscosities) while being able to integrate many types of decorative packaging. Obtaining such a system is highly complex because many parameters interact, often in an opposing manner.

The invention aims to overcome one or more of the disadvantages of the prior art and to propose a packaging and dispensing device that is very suitable for the various requirements of the practice (including the leaktight requirement and, if necessary, the non-removable characteristic) and is compatible with very different options for decorative packaging.

To this end, the invention proposes a device for packaging and dispensing of the abovementioned type with a metering assembly adapted to dispense a predetermined dose of product and provided with a plugging element which extends around the metering pump and defines a lower face of the head (at least a portion of the filling opening can be closed by the plugging element), with the characteristic that the body and the container are secured to one another by an annular ring which is part of the reservoir portion (ring that is separate from the body and the container, and preferably made as one piece) and extends between an inner surface engaged against the upper end of the container and a peripheral surface for attachment to the body, the connection interface comprising the upper end of the container, which may be of the neckless type and comprises at least one leaktight movable wall that is movable towards the inlet in order to compensate for negative pressure in the reservoir (negative pressure briefly created by extraction of the dose at each use), the upper end being adapted to engage with the plugging element to define an annular contact to seal the container-plugging element.

This arrangement with a ring for adapting to the external shape of the decorative body allows great flexibility. The plugging element which partly surrounds the metering pump, and more generally the metering assembly, does not need to have particular dimensions, as the attachment contact with the body is made by the ring. Advantageously, the ring allows:

establishing the connection between the container (interior) and the packaging body (exterior), it being possible to implement this function during a pre-assembly of the reservoir portion at the packaging manufacturer (here this involves establishing the connection between the functional interior and the aesthetic exterior); and adapting the reservoir portion to the shape of the dispensing head, so that the final assembly can be carried out at the packager after filling, which is highly attractive from a logistics point of view (pre-assembly can be carried out without needing to fill the container immediately, the connection between the reservoir portion and the dispensing head corresponding to a final mounting step).

In other words, a functional portion of the device is defined which is entirely internal, formed by the metering assembly and the container provided with the connection interface. This functional portion, which satisfies strict leaktight requirements, particularly in the cosmetic or pharmaceutical fields before and even after the first use, can be designed separately from the packaging portion. The functional portion can thus be produced in very large numbers (several million, for example), while being incorporable into a customized device (customized in shape and choice of body material) due to the adapter ring.

The movable wall of the container is thus very well protected. It ensures a leaktight separation and maintains an identical pressure between the fluid product contained in the reservoir and the air of the peripheral volume located underneath the ring (between the container and the body).

The plugging element, typically in the form of a hollow protective part extending axially from the lower face, is in direct contact with the container, which eliminates the need for an O-ring.

The positioning of the adapter ring around the filling opening of the container, in other words at the connection between the container (bottom) and the dispensing head (top), is advantageous for keeping the lateral decorative packaging away from the container, which allows the use of a wide range of materials (without excluding very rigid and/or non-plastic materials) to form a vial or bottle body, preferably as one piece for a uniform aesthetic appearance (single-unit body that covers the reservoir portion and which, in some options, may also cover the sides of the dispensing head).

The container may have a cylindrical or near-cylindrical shape (for example slightly frustoconical) and contain the product filled to a level substantially corresponding to the upper annular edge of the body. The wide opening of the container (neckless) facilitates filling.

The filling process may in practice be as follows: a hollow tube is introduced into the container, by which the product is poured into the container, this tube descending to the bottom of the container and then progressively ascending during filling. The diameter of the tube is limited by the diameter of the bottle opening minus the minimum operating clearance. In prior art devices, a typical opening is defined by a neck having an inner diameter of about 8 mm, which allows introducing a tube with an outer diameter of 6 mm and inner diameter of 5 mm maximum. With such an inner diameter, there is a significant head loss for liquids of high viscosity, which:

i) reduces the flow rate; and ii) creates shearing of the formulation which may affect its homogeneity, for example in the case of emulsions which tend to separate.

Furthermore, for packaging a viscous product, a small tube diameter results in a dome shape on the upper face of the product, therefore a wait time or additional mechanical action to flatten the surface before closure.

In the present case, the container is preferably not tapered at its upper end and the opening may typically define a diameter of at least 15 or 16 mm, preferably greater than 20 mm. Such a diameter of the filling opening can be at least 75 or 80% of a container diameter defined around a piston at the lower end of the container. The size of the opening diameter can be greater, within the limits of the container diameter (corresponding where appropriate to 100% of the cross-section of the container).

In various embodiments of the device of the invention, one or more of the following arrangements may possibly be used:

the plugging element comprises an insertable plug portion in annular radial sealing contact with an inner face of the upper end, for example such that the upper end and the plugging element are connected by fitting them together in a leaktight manner;

a flange adjacent to the insertable plug portion is formed on the plugging element (and thus typically located entirely outside of the internal volume of the container);

the plugging element forms a support part for the metering pump, typically supporting it from below; it is understood that this plugging element supports the metering pump (not vice versa);

the insertable plug portion comprises an insertion portion of cylindrical cross-section inserted through the upper end of the container and through an opening in the ring and coaxial with a central channel for accommodating and supporting the metering pump;

the stationary portion comprises a retaining piece which is more rigid than the plugging element and which extends annularly around the plugging element, the retaining piece being configured to be engaged with the ring such that the plugging element is held clamped between the upper end of the container and the retaining piece;

the plugging element is preferably formed as one piece;

the flange of the plugging element is caught between the retaining piece and an axial support edge of the upper end adjacent to the inner face;

the upper part of the container and the metering assembly are in direct contact with one another, with no use of an additional gasket;

the retaining piece is essentially of a first rigid material, preferably chosen from the following families of materials: polyolefins, styrenics, copolyesters, polyacetals, polycarbonates, polyamides, while the plugging element is essentially of a second material that is more flexible than the first material, preferably low density polyethylene or an elastomer;

the body is constructed as one piece and has an upper opening, the ring closing off the upper opening without interfering with the filling opening;

the container is of the neckless type;

the container has a circular cross-section, at least at the upper end, the ring defining a circular opening for inserting the container into an internal volume of the body;

the body defines a first decorative periphery, the head having an annular connector integral to said stationary portion and which surrounds the metering assembly to define a second decorative periphery;

the head further comprises a removable cap, fixed to the annular connector in a storage configuration, the body, the annular connector, and the cap giving the device its external form in the storage configuration;

the body has an annular upper face from which an annular projection extends to a support edge, an external shoulder being defined by the annular upper face surrounding the annular projection, the annular connector extending around the annular projection and abutting against the external shoulder;

the annular projection has at least one first retaining relief on an inner face, and at least one second retaining relief on an outer face;

when the head is mounted on the reservoir portion, the first relief and the support edge form abutments of different and preferably opposite orientation to lock the ring axially relative to the body, while said second relief and the external shoulder form abutments of different and preferably opposite orientation to lock the annular connector axially relative to the body;

when the body comprises a bottom, at least one lower bearing surface which has a pressure equalization hole is provided to define a base plane of the body; this hole may be offset relative to the lower bearing surface such that it is inset from the base plane;

the body comprises a one-piece tube defining a single lateral decorative periphery around the container and the metering assembly;

the stationary portion comprises a retaining piece that extends annularly around the plugging element and has a lower portion in contact with the ring, and preferably in engagement with the inner surface of the ring so as to be axially integral with the ring;

the retaining piece extends longitudinally from the lower portion to an upper end portion in engagement with an external flange formed on the metering pump;

the plugging element defines with the retaining piece an annular groove that is part of the head, the upper end defining an axial support edge inserted into the annular groove when the head is mounted on the reservoir portion;

the retaining piece has an inner skirt which defines with said lower portion a determined annular groove opposite the upper end portion, the plugging element and the upper end of the container being in annular sealing contact with one another within the determined annular groove when the head is mounted on the reservoir portion;

the inner surface of the ring has an inner flange, preferably annular, in axial contact from below with a collar or collar portions of the container, at the upper end;

the ring comprises a substantially flat radial portion extending between an inner flange and an annular outer flange, the inner flange defining an opening of the ring which is preferably located above an internal volume of the body;

the ring further comprises a continuous or segmented (for example slotted) skirt extending longitudinally towards the bottom from a lower face of the radial portion, the peripheral surface for attachment to the body being defined by the skirt and by the underside of the outer flange;

the ring comprises a protruding upper portion extending longitudinally about a longitudinal axis of the container from an upper face of the radial portion, internal reliefs being formed on the protruding upper portion, projecting radially inwardly and facing the upper end of the container so as to engage with a portion, preferably a flange, of the metering assembly;

the upper end of the container defines a sealing seat which is for example conical with a cross-section that widens towards an axial support edge (the edge can form an abutment area of contact with an annular surface of the plugging element set back with respect to an insertable portion of the plugging element);

the container is substantially cylindrical and extends around a longitudinal axis, the leaktight and movable wall being formed by a piston that is movable in translation along the longitudinal axis;

the container has a side wall adapted for guiding a piston, the side wall having a circular cross-section that widens towards a lower end of the container and extending as far as an opening for mounting the piston in the container;

the leaktight and movable wall is formed by a retractable flexible portion, the upper end of the container forming a rigid connector;

The invention also relates to a method for assembling a device for dispensing a product in metered quantities, which facilitates the logistics between the functional dispensing portion (which may come from a mass production factory) which includes the movable part or parts and the sealing region between the reservoir and the metering assembly, and the outer portion (which may be highly customized and produced in a possibly very low number of units).

To this end, an assembly method for obtaining a device for packaging and dispensing according to the invention from a reservoir portion and a head is provided, wherein the fluid product is introduced through a filling opening, before a final step of mounting the head on the reservoir portion, into a container that is part of the reservoir portion, the method comprising the steps consisting essentially of:

combining, in an airless type of metering assembly:

i) a stationary portion provided with a plugging element which forms a lower face of the head, and ii) a metering pump connected to an actuation portion that is movable and intended for controlling the dispensing of fluid product in response to an action on the actuating portion, so that the plugging element surrounds the metering pump;

inserting the container through an opening defined by an annular ring and mounting the ring in a body which is hollow and defines a decorative periphery at least for the reservoir portion, such that the container is held in the internal volume of the body while the ring extends around the filling opening opposite to the bottom or lower edge of the body;

wherein the body and the container are rendered integral with one another by:

i) engaging, against the body, a peripheral surface for attachment to the body formed at the periphery of the ring; and ii) engaging an inner surface of the ring against the upper end of the container;

the container being for example of the neckless type for defining said filling opening and comprising at least one leaktight an movable wall that is movable towards said inlet in order to compensate for any negative pressure in the reservoir (such that the wall moves to reduce the volume of the reservoir along with the removal of product with each use);

and wherein the final assembly step is carried out by connecting the plugging element to the upper end of the container in order to seal the filling opening (defining an annular static sealing contact directly between the container and the plugging element).

This guarantees that a high level of static sealing is maintained between the container and the head, because the container opening is not deformed (as might be the case if one had created a flange or similar ridge portion integral to the container which would be connected to the shape of the decorative packaging, not necessarily circular).

In the case of decorative packaging having at least two superimposed parts, the container is typically introduced into the body from above, through the opening in the ring, which can eliminate an additional operation of closing the bottom by a cover after the container is in place. In addition, it is possible to assemble the lower reservoir portion without deformation of the wall. This ensures satisfactory subsequent operation of the dispensing device.

In the case of integral decorative packaging by a continuous tube or similar sleeve for the body, the container is instead introduced through a bottom opening of said tube, and a cover is added to form the bottom. It will be understood that, due to the ring, the static sealing region can be large and kept at a radial distance from the decorative packaging, regardless of the type of body actually used around the reservoir.

BRIEF DESCRIPTION OF THE DRAWINGS

Other features and advantages of the invention will be apparent from the description given below with reference to the accompanying drawings, which illustrate non-limiting examples of embodiments and implementations of the object of the invention. In these drawings.

In the various figures, the same reference numbers designate similar elements in the various embodiments represented and described.

DETAILED DESCRIPTION OF THE PREFERRED EMBODIMENTS

Figure 1:
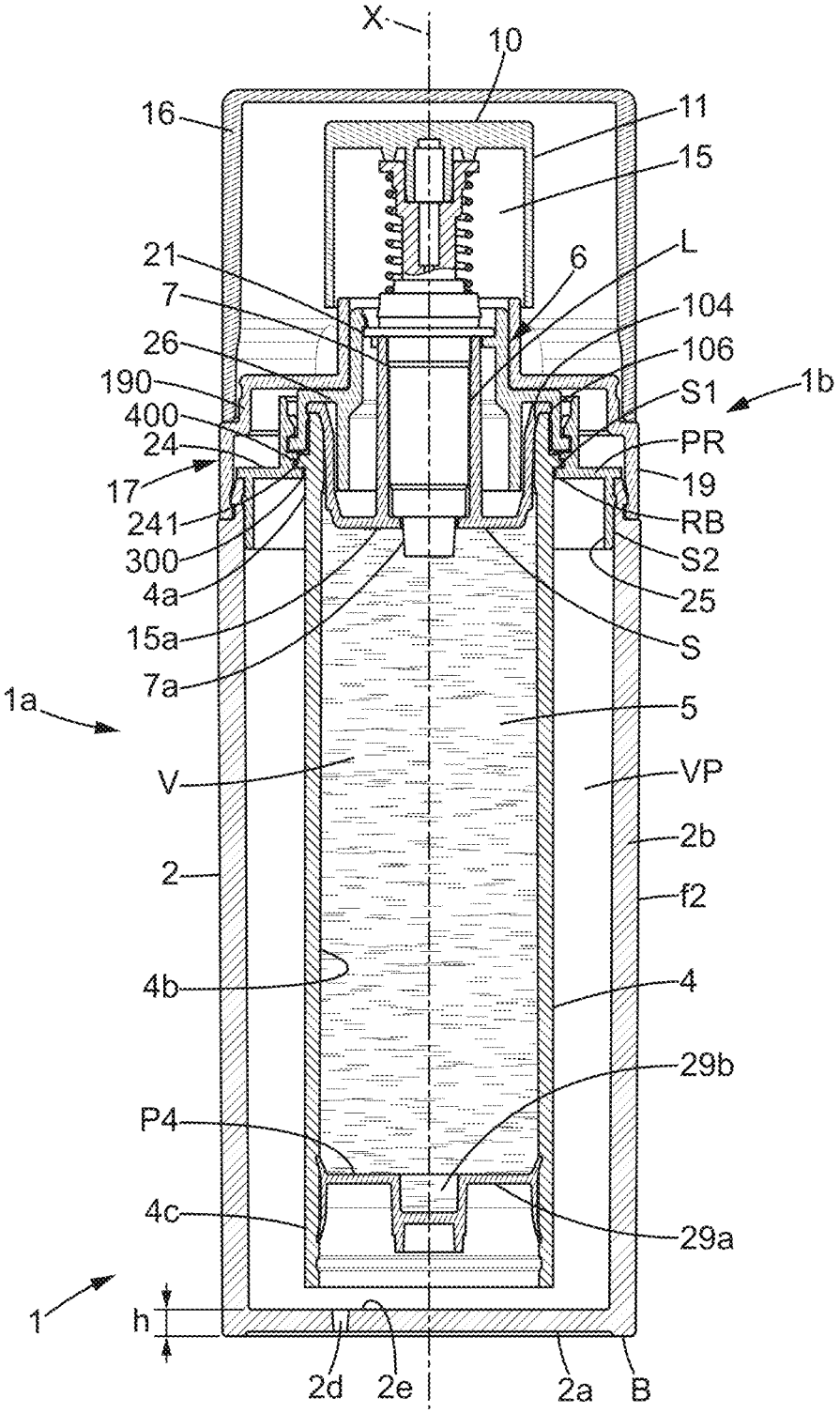
FIG. 1 is an axial sectional view of a device according to the invention, which in particular has two parts sealingly assembled to one another at the upper end of the container which forms the reservoir of product.

As shown in FIG. 1, the packaging and dispensing device 1 comprises a body 2 (typically a bottle body) with a bottom 2*a* which defines a support base B, a container 4 which extends (fully, mostly, or partially) within the body 2 and allows storing the liquid or viscous product 5 to be dispensed, a plugging element S, preferably of thermoplastic material, assembled to the container 4 in a leaktight manner and which is part of an end piece 6. In a non-limiting manner, the body 2 may be defined by a single part of preferably rigid material, for example glass or plastic, opaque, translucent, or transparent. Alternatively, all or part of the body 2 may be made with metal. A coating may be provided to cover all or part of the outer face f2 of the side wall 2*b* of the body 2. The decorative coating may include any surface treatment compatible with the material of the body 2, for example lacquer on glass, metallization on plastic, anodization of aluminum . . . and/or any decoration by methods such as hot stamping, screen printing, pad printing, label application, laser etching, etc.

In this first embodiment, the body 2 and the container 4 are part of a reservoir portion 1*a* of the device 1. The container 4 defines the reservoir of the reservoir portion 1*a*. The complementary part of the reservoir portion 1*a* is a head 1*b* which includes the dispensing functions. A contact obtained between the head 1*b* and the reservoir portion 1*a* during assembly after filling establishes the seal between an upper end 4*a* of the container 4, which is tubular and in practice is circular in cross-section (without being limited to this), and a complementary surface which is part of the head 1*b*.

Even when the body 2 and the head 1*b* have outer decorative surfaces of which the respective circumference is not the same shape, it is preferable that the upper end 4*a* be circular, this shape being optimal for obtaining perfect static sealing without the need for an additional gasket. Thus, the container 4 has a filling opening O at the upper end 4*a* which is typically circular, as can clearly be seen in FIG. 2.

The container 4 is tightly sealed by the plugging element S, here formed as one piece, in an annular connection area. This means that the container 4 can be filled after the container 4 is placed within the body 2, just before placement of the head 1*b* (the latter also having been fully assembled with its decorative packaging portion or portions). As is clearly visible in FIGS. 1 and 3, the plugging element S will only fit partially into the internal volume of the container 4.

Figure 2:
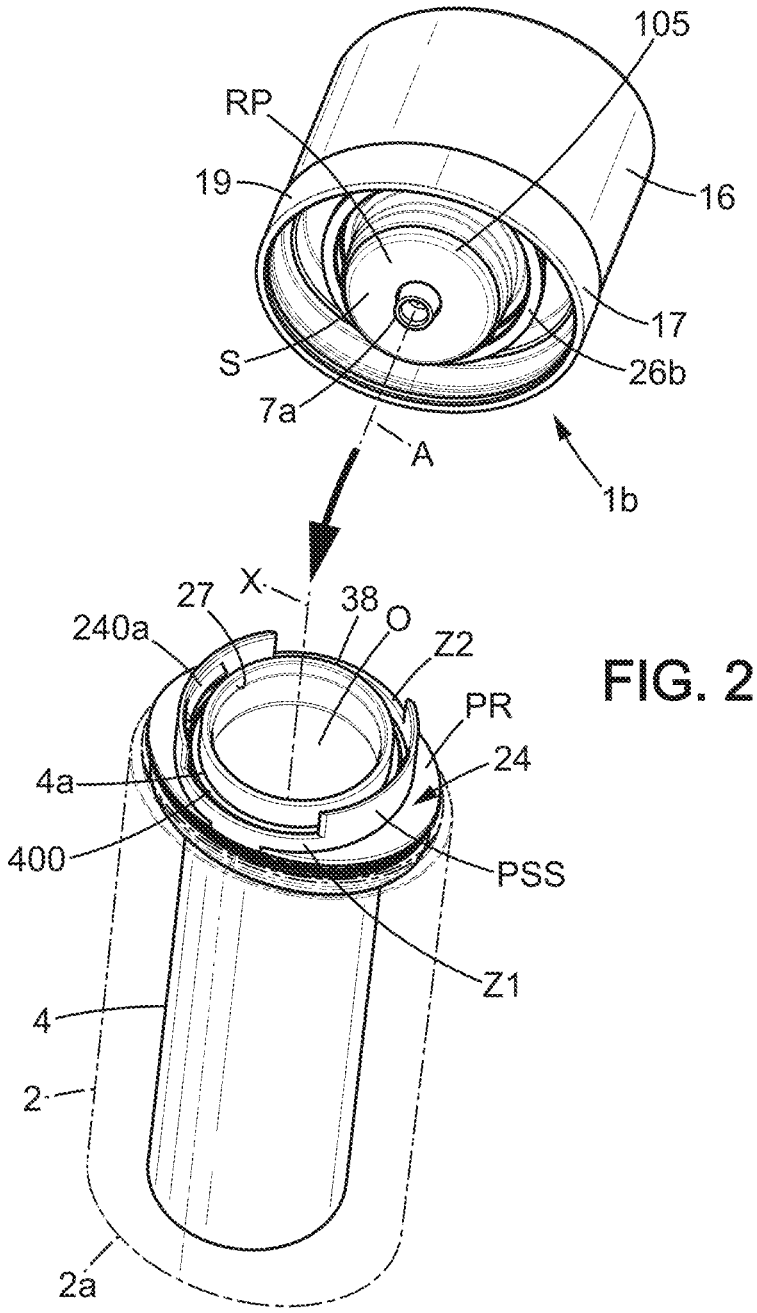
FIG. 2 represents the components of the device of FIG. 1 but separately in a perspective view, showing the top of the reservoir portion (lower part before filling with product) and the underside of the head, with an insertable portion adapted to engage with a sealing seat defined by the upper end of the container.
Figure 3:
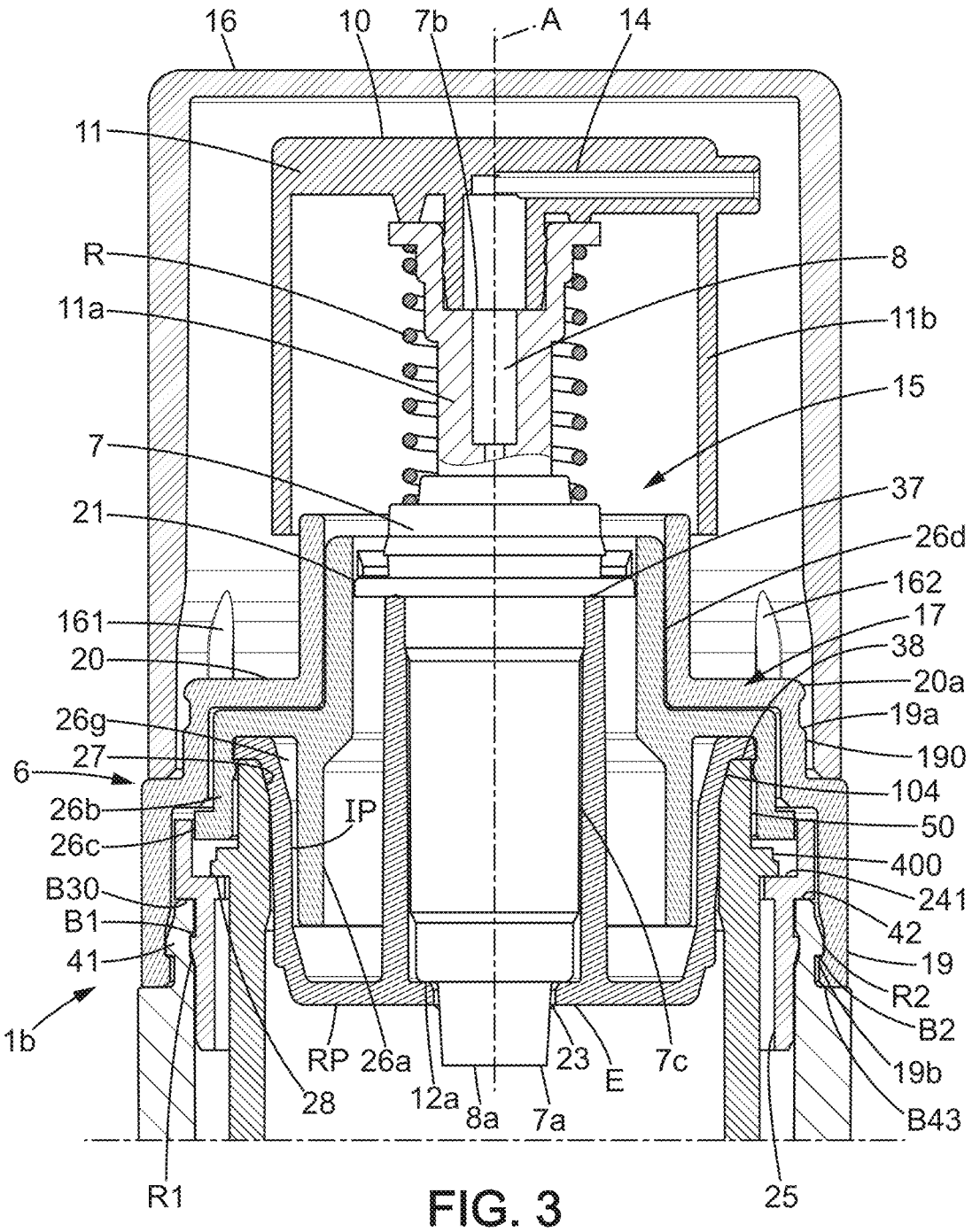
FIG. 3 is an axial sectional view showing the connection between the reservoir portion and the head of the device of FIG. 1 but in more detail, with an angular offset of 90° with respect to the sectional view of FIG. 1.

Referring to FIGS. 1 to 3, the circular shape is also particularly well suited for enabling the container 4 to be extended axially by a metering assembly 15 which includes a metering pump 7. The central axis X about which the container 4 extends longitudinally, may coincide with an axis A of the metering pump 7, in particular when it includes an axially movable member such as a piston.

Referring to FIG. 3, a metering pump 7 which has an inlet 7*a* is mounted in the end piece 6. The plugging element S forms a supporting part for the metering pump 7, here supporting it from below. Thus, this plugging element S supports the metering pump 7 (and not vice versa), for example by holding it at a predetermined level at the upper end 4*a* of the container 4. The inlet 7*a* is defined at a first end 8*a* of a dispensing channel (not shown). The pump 7 is of the "airless" type, meaning without air intake, with a stem 11*a* or similar movable part actuated by depression of an actuator, generally arranged in the upper portion of the device 1, thereby allowing the fluid forming the product 5 to exit through a nozzle or similar delivery member 14, or to exit through an applicator member (in the case of an applicator tip).

An actuating portion 10, for example located in the end piece 6 opposite to the inlet 7*a* of the metering pump 7, is provided to enable the product 5 to exit the end piece 6 at an outlet 7*b* of the metering pump 7.

The actuating portion 10 is typically defined by a pushing member 11 which is movable along a longitudinal axis which may be parallel to the central axis X of the container 4. The pushing member 11 has a substantially tubular wall 11*b* and is connected from above to the upper end of the stem 11*a*. The plugging element S is integral with an insertion portion 12 which is part of the metering pump 7. It is understood that the first end 8*a* is part of the insertion portion 12 and may, according to one option, project relative to the plugging element S so as to extend in a direction opposite to the actuating portion 10 (in practice: projecting downwards when the package and dispensing device 1 is in a vertical position with the bottom 2*a* defining a support base B).

The body 2 is provided with a side wall 2*b* extending longitudinally about the central axis X from the bottom 2*a* to an annular edge 2*c* which defines an upper opening 13. The cross-section of the upper opening 13 can be wide due to the fact that the body 2 has no neck here (and is more generally a neckless body). The upper opening 13 can typically be as wide as the cross-section of the body 2 when this cross-section is substantially constant. It is understood that the movable actuating part 10 here may extend entirely above the upper opening 13 (non-limiting option).

The delivery member 14, for example in the form of a nozzle, is in fluid communication with the outlet 7*b* for delivering and directing a dose of product. Although the illustrated examples show a dose delivered in a radially outward direction, other configurations are possible: for example with the product exiting in a substantially axial direction or in a direction (typically non-vertical) forming any angle with the direction of elongation of the device 1. This delivery member 14 extends transversely in a position adjacent to the actuating portion 10 and follows the movement of the pushing member 11. Locking the pushing member 11 in a raised position may optionally be provided, for example with a contact stop surface when this pushing member 11 is turned to deviate from a predetermined direction of the delivery member 14. A slot separating two stop regions can thus allow the pushing member 11 to move along the predefined orientation.

As is clearly visible in FIG. 1, the end piece 6 may be covered, partially or completely, by a cap 16. The end piece 6 is divided here into a metering assembly 15 (including in particular the metering pump 7, the plugging element S, and the actuating portion 10) arranged in the extension of the container 2. An annular connector 17 may be provided to allow locking together the two sub-assemblies shown in FIG. 2, further serving to secure the cap 16 in a detachable manner.

The annular connector 17, which extends under the actuating portion 10, corresponds here to a ferrule in an intermediate position between the body 2 and the cap 16. In this non-limiting example, the annular connector 17 acts as decorative packaging for the upper part of the device 1 in combination with the cap 16. Optionally, the annular connector 17 allows locking the pushing member 11 in the raised position.

Figure 5:
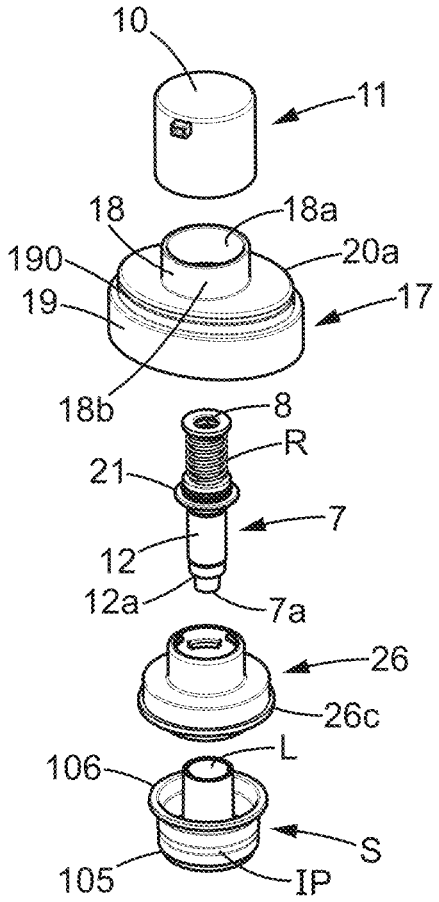
FIG. 5 is an exploded perspective view of the component elements of the head of the device of FIG. 1.

In the configuration illustrated in FIG. 5, the pushing member 11 may cover portion 18 of the annular connector 17, at least when it is actuated to dispense the product 5. However, it may be advantageous when it is the pushing member 11 which slides inside a decorative packaging part, for example with a configuration that renders the pushing member 11 non-detachable (by means of an annular bead, retaining lugs or ribs of the pushing member 11). The latter configuration is advantageous when wanting to ensure that the circuit for the product 5 is not broken.

Figure 10A:
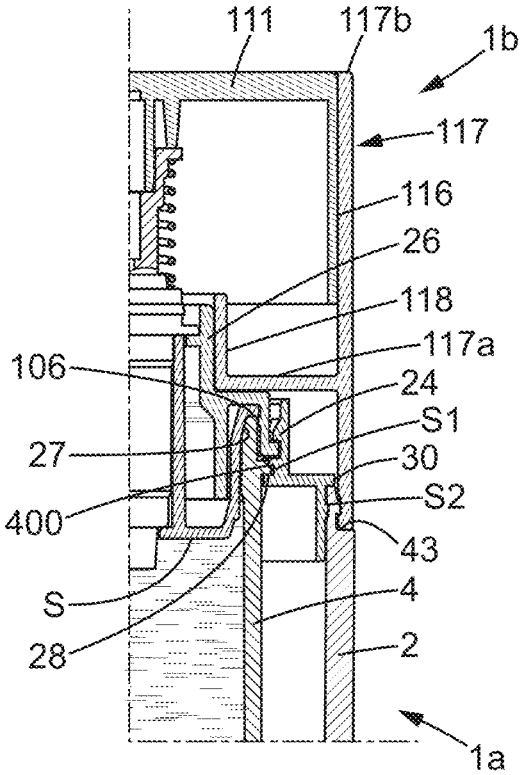
FIGS. 10A and 10B are respective views in axial section of two alternative embodiments for the decorative packaging of the device.
Figure 10B:
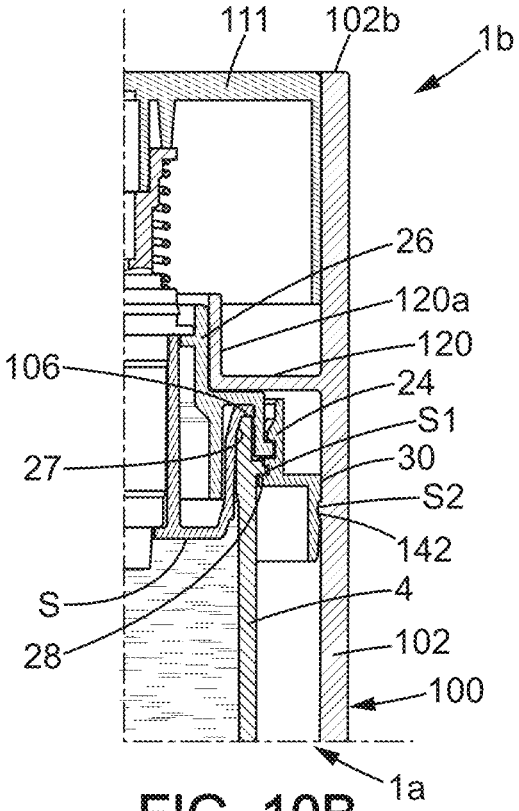
Figure 12:
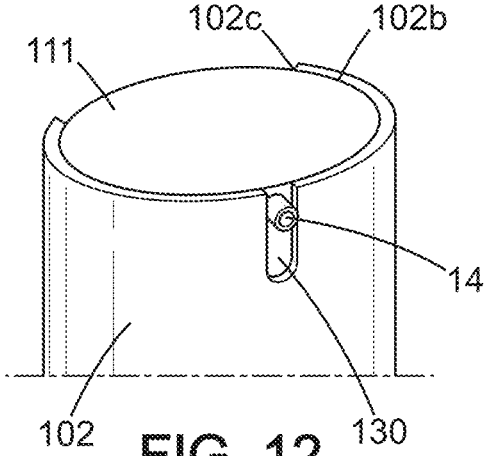
FIG. 12 is a perspective view of the top obtained with the decorative packaging shown in FIG. 10B.

In FIGS. 10A, 10B and 12, one can see alternative embodiments with mounting of the pushing member 11 which allows retention by an external decorative packaging part. For example, an annular connector 117 may be provided (the case in FIG. 10A) which consists of:

a lateral decorative sleeve 116 of the head 1*b*; and a radial portion 117*a* extended by a section of tube 118.

Such an annular connector 117 has many similarities with the annular connector 17 provided in the embodiment of FIGS. 1-5 and essentially differs in that the sleeve 116 extends upward to an end 116*b* which surrounds the actuating portion 10, so that the cap 16 is no longer necessary.

In the case of FIG. 10B, it is a tube 102 which defines a decorative packaging shared by the reservoir portion 1*a* and the head 1*b*. No annular connector (17 or 117) distinct from the body is therefore provided. A bottom 200 must then be attached to the end 102*a* of the tube to form the body 100 and close the device 1 from below (thus protecting the lower end 4*c* of the container 4).

Referring now to FIG. 3, the metering pump 7 has a pump body 7*c*, here cylindrical and provided with an external flange 21. The insertion portion 12 which extends below the flange 21 is housed in a channel L (also cylindrical) of the plugging element S.

The operation of the metering pump 7 is of a type that is known per se, for example with a piston integral with the stem 11*a* (configured to increase the pressure within a metering chamber), slidably mounted in a longitudinal dispensing channel. A check valve provided at the inlet 7*a* defines a leaktight separation between the volume V of the reservoir and the dispensing channel of the pump 7.

When the pushing member 11 is depressed, here in response to vertical manual pressure exerted on the actuation portion 10, the stem 11*a* is lowered along with an inner actuating member (for example a piston) that actuates the dispensing. During actual use, the cap 16 is of course removed so that the upper surface of the actuation portion 10 (here formed by a pushing member 1 having a tubular wall 11*b* which surrounds the spring R) is exposed for actuation.

More generally, it is understood that the metering assembly 15 allows delivery of a specific dose of the product 5, this dose being ejected by creating a vacuum inside the container 4. Because the pump 7 discharges the product 5 by creating a vacuum (negative pressure), a leaktight and moveable wall P4 is provided here, typically at the bottom of the container 4, which moves upward to compensate for the negative pressure such that the device is returned to the ambient atmospheric pressure before the next activation. The cross-section of this wall P4 is complementary to the tube defined by the container 4, and in particular is circular in the example shown.

A container 4 of circular cross-section is advantageous for obtaining satisfactory dynamic sealing performance at the piston 29 and static sealing performance at the interface between the lower reservoir portion 1*a* and the head 1*b* (top dispensing portion).

Figure 7:
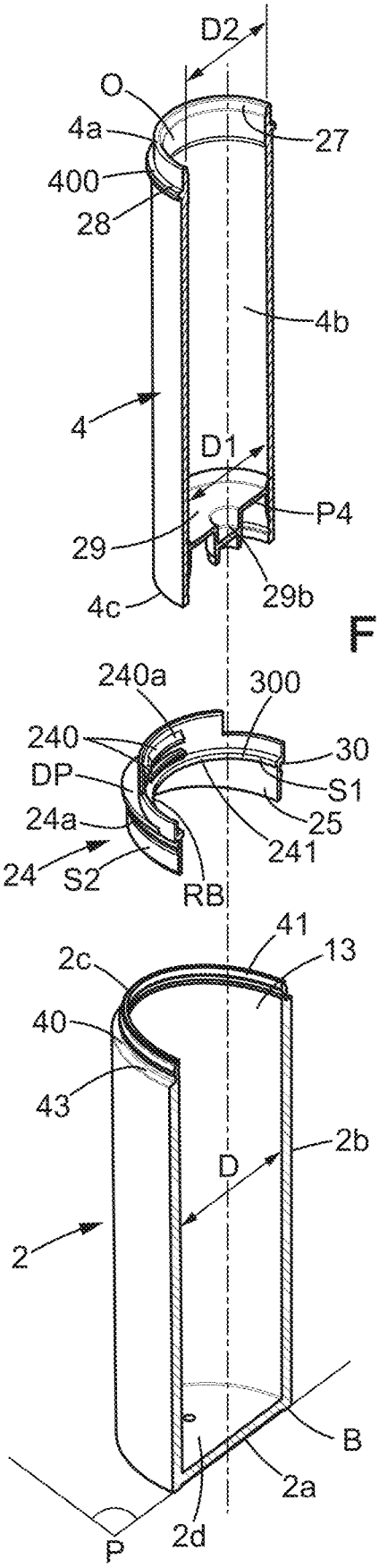
FIG. 7 illustrates axial sectional views of a mode of mounting the lower portion to the reservoir, with a container of circular cross-section fitting into a body having an oval cross-section.

As illustrated in FIGS. 3 and 7 in particular, the container 4 can be made integral with the body 2 and/or centered with respect to the side wall 2*b*, by means of a ring 24 which fits into the opening 13, presenting an external shape corresponding to the inner circumference of the body 2 near the annular edge 2*c*.

The ring 24, which is annular in shape, extends around an opening providing passage for the container 4. An annular bead 400, a collar, and/or lugs formed on the outer face of the container 4, near the opening 13, come to bear on one or more flanges RB forming an axial stop surface, which locks the container 4 in an insertion configuration within the body 2. The container 4 can be thus held at a distance from the bottom 2*a* of the body 2 or at a predetermined relative distance from an annular lower edge of the body 2.

Both in this first embodiment and in the variant embodiment of FIG. 10A, the configuration of the parts is designed here so that the container 4 is prevented from sinking into the body 2 during forced insertion of the head 1*b* (after filling). This is achieved by the lower surface of the bead 400 and the corresponding surface of the ring 24. It is understood that the ring 24 provides moderate retention of the elements of the reservoir portion as shown at the bottom of FIG. 2 (with the container 4 held integral with the body 2 during the intermediate handling and transportation, which is a temporary situation), while in the situation after final assembly as illustrated in FIGS. 1 and 3, the parts are inseparable.

In the non-limiting example of FIG. 1, the annular bead 400 may extend below one or more internal reliefs 240 formed on the ring 24. These reliefs 240 are outwardly offset so as not to interfere with placement of the container 4 within the body 2 (here these reliefs 240 extend outside a virtual cylinder parallel to the central axis X and defined by the flange RB). Thus, it is the flange RB which defines the size of the opening 300 or the narrowest cross-sectional area of the ring 24. In this configuration, the container 4 is not stressed by clamping contacts (no radial engagement) during its placement in the body 2. There is no permanent deformation due to creep and, more generally, no risk of deformation of the cross-section (here perfectly circular) of the container 4.

The container 4 may be suspended by means of the ring 24, with no axial support of the lower end 4*c* against the bottom 2*a*. This provides great freedom in the shape of the bottom 2*a* of the body 2, which for example may have a hemispherical inner surface if this part of the body plays no mechanical interface role with the container 4. Referring to FIGS. 1, 2 and 7, the container 4 is inserted from above and comes to rest axially on the annular inner flange RB formed in the inner surface S1 of the ring 24, here in the (inward) extension of an annular radial portion PR.

As illustrated in FIGS. 1-3 and 7-8, it is understood that at least the first end 4*a* of the container 4 is rigid and may define:

- a first leaktight annular area of contact 27 with the plugging element S, in an assembled state, such that the product 5 can only exit the container 4 through the first end 8*a* of the dispensing channel 8 (via the inlet 7*a* of the metering pump 7); and
- a second annular area of contact 28 with an inner face 241 of the ring 24, such that the container 4 is secured to the body 2.

In this non-limiting example, the first area of contact 27 is obtained at an inner annular portion of the first end 4*a* of the container 4, while the second area of contact 28 is defined at an outer annular portion of the first end 4*a*. The container 4 further comprises at least one leaktight and movable wall P4, which allows the volume V of the reservoir defined by the container 4 to gradually decrease as the product 5 is consumed. Of course, the first area of contact 27 may be defined differently in some alternatives, for example by an annular contact located on the outer side of the first end 4*a*, closer to the opening 13 than the second area of contact 28. More generally, the first area of contact 27 may be selected among the inner surface, the outer surface, the upper surface, one of the two angles, or a combination of these surfaces of the end 4*a*.

Referring to FIGS. 1 to 3, the container 4 may be firmly held in its position inserted into the body 2 by assembly parts of which at least one is integrally attached to the pump 7, and at least one other is integrally attached to the body 2. The plugging element S advantageously forms one of these assembly parts. The method of leaktight attachment between the container 4 and the plugging element S can be made robust:

- by using a conical surface in the upper end 4*a*, which defines the first annular area of contact 27, and
- by covering the plugging element S with a retaining element or part 26 (here formed by an additional part) held axially towards the bottom 2*a* by the ring 24, in particular by the internal reliefs 240 in the non-limiting example of FIG. 1.

As is clearly visible in FIG. 3, the annular surface is formed on a flared inner face 104 of the upper end 4*a* and may have a sloped portion extending radially inward and towards the bottom 2*a*, from an upper radial portion.

The insertable plug portion 105 which is part of the plugging element S is in annular radial sealing contact with the inner face 104 of the upper end 4*a*, such that the upper end 4*a* and the plugging element S fit together in a leaktight seal. The first annular area of contact 27 is defined here at a flange 106 of the plugging element S which is axially distal from the bottom 2*a*. In the example of FIG. 1, one can see that the flange 106 covers the inner face 104.

The interlocking between the end piece 6 and the upper end 4*a* may be as follows:

- the male conical seat of the plugging element S is of a slightly larger diameter than the female seat defined by the inner face 104;
- during the final assembly, the outer flange 26*c* of the retaining piece 26 snaps into the internal reliefs 240 of the ring 24;
- this snap-fitting forces the flange 106 to bear against the axial support edge 38 of the upper end 4*a;*
- this action radially compresses the male conical seat of the plugging element S (which is flexible) so that it adapts to and fits into the shape of the female conical seat defined by the inner face 104 of the upper end 4*a*.

A very good seal is created with this type of shaping (with forced engagement). A significantly high level of seal can be obtained by combining a rigid material and a flexible material able to adapt to the shape of the rigid material in order to closely match its form. Here, for example, it is the container 4 which is rigid, made for example of polypropylene, copolyster or polyamide, and it is the plugging element S which is flexible, made for example of low-density or medium-density polyethylene. Of course, one can reverse the materials (the container 4 can be more flexible than the plugging element S, at least locally).

To preserve the integrity of the two facing conical seats which establish the seal, it is understood that the plugging element S and the container 4, which face each other, are preferably of cylindrical symmetry. Thus, any deformation in the circularity at the connection disrupts the uniformity of the pressure of the two conical seats against one another. In practice, the axial annular contact at the axial support edge 38 does not ensure the seal by itself but serves to maintain a good level of radial compression at the conical seats.

As can be seen in FIG. 3 (also see FIG. 5), the insertable plug portion 105 comprises an insertion portion IP of substantially cylindrical cross-section, between the flange 106 and a radial portion PR which is axially proximal to the bottom 2*a*. The insertion portion IP of cylindrical cross-section is inserted through the upper end 4*a* of the container 4 and through the opening 300 of the ring 24. The insertion portion IP is coaxial, about the longitudinal axis A of the pump 7, with the channel L formed centrally in the plugging element S for receiving and creating the seal around the metering pump 7. To this end, in addition to the annular area of contact 27 with the upper end 4*a* and as is clearly visible in FIG. 3, a radial sealing contact between an annular lip 23 of the plugging element S and a seat defined at the inlet 7*a* of the pump 7 is provided. The annular lip 23 is reshaped by conical contact (same principle as for the conical seat at the upper end 4*a*) with the end of the pump 7 which defines the inlet 7*a*.

According to one option, an annular bead (not shown) is formed inside the channel L of the plugging element S, near its axial upper end 37. This bead engages with the body of the pump 7 near its flange 21, therefore at its most rigid location axially.

As illustrated in FIGS. 1 and 3, the plugging element S is shielded at its flange 106 by the retaining piece 26. The plugging element S and the retaining piece 26 are part of a stationary portion of the metering assembly 15, which preferably creates a sufficiently robust attachment to the body 2 and to the container 4 to withstand a drop test (corresponding to a fall of 1.5 m onto a hard surface as in the test specified in document ASTM D6344-04 (2009)), without breakage of any of the internal parts and without compromising the operation of the metering pump 7 or breaking the seal.

The retaining piece 26, which is rigid, may be based on polypropylene, similar rigid polyolefin, or selected from the following families of materials: styrene, copolyesters, polyacetals, polycarbonates, polyamides.

Figure 11:
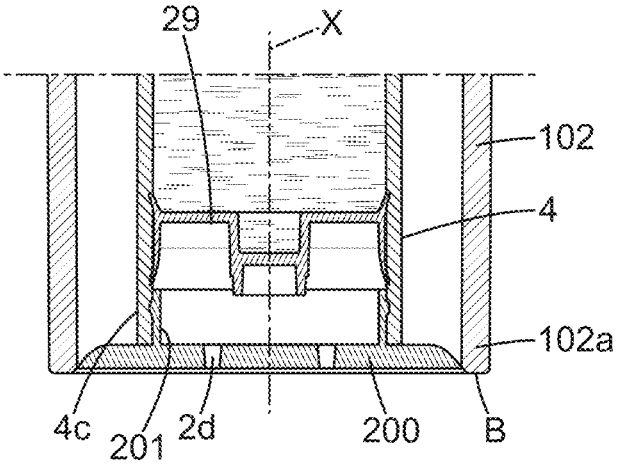
FIG. 11 is a detail view in axial section illustrating an exemplary bottom of the device when the body is formed by a sleeve.

Referring to FIGS. 10B, 11 and 12, we now describe an alternative embodiment with a body 100 that is divided into a lateral decorative packaging tube 102, cylindrical or non-cylindrical, and a bottom 200 (here in the form of a lower cover). While the tube 102 is used for mounting the metering assembly 15 and must be considered an element integral with the head 1*b* which is to be connected to the reservoir portion 1*a* during the final stage of assembly, the bottom 200 can be considered part of the reservoir portion 1*a*.

In this case, the same performance is obtained for the static sealing and the protection against disassembling the circuit because the respective areas of contact (27, 28) of the upper end 4*a* are the same. The ring 24 provided in the device of FIG. 10B can be identical or very similar to that of FIGS. 1 and 10A. Here the tube 102 is a one-piece element which defines a single lateral decorative periphery around the container 4 and the metering assembly 15.

The lower end 102*a* of the tube 102 defines an opening for mounting the cover which forms the bottom 200. In contrast to the embodiments where the container 4 is suspended without contact with the body 2 (by means of the support function of the ring 24), the container 4 here can be in contact with the base 200 of the body 100. An insertable portion 201 of this bottom 200 may optionally enable connecting the bottom 200 to the lower end 4*c* of the container 4.

Here the head 1*b* has a pushing member 111 mounted internally within an upper compartment defined by the tube 102. A transverse wall 120 formed in the tube 102 defines a separation between this upper compartment and a lower compartment within which the reservoir portion 1 is housed at the end of the final stage of assembly. This wall 120 meets and extends around a channel 120*a* (which is functionally comparable to channel section 118 or to portion 18 of the annular connector 17) to wrap around a portion of the metering assembly 15.

It is understood that in this case, the container 4 is positioned inside the body 100 only after the final stage of assembly which establishes the static sealing between the container 4 and the plugging element S, by fitting the reservoir portion 1*a* into the tube 102 through the lower end 102*a*. Specifically, the ring 24 of the reservoir portion 1*a* is slid until engagement of the ring 24 and the retaining means 142 formed on the inner face of the tube 102 in the lower compartment. In one non-limiting example, these retaining means 142 may simply correspond to reliefs projecting radially inward which the ring 24 snaps onto. An annular bead of the peripheral surface S2 may optionally be provided on the ring 24 to achieve such a snap-fit.

Referring to FIG. 11, the attachment between the bottom 200 and the container 4 may either be done prior to the final stage of assembly, or may be part of the final stage of assembly (by attaching the base 200 to the container 4 and to the lower end 102*a* of the tube 102 at the same time).

Referring to FIGS. 10A, 10B and 12, the pushing member 111 is internally mounted, either in an upper compartment defined by the annular connector 117 (the case of FIG. 10A)

or in the upper compartment defined by the tube 102. The upper compartment has an axial opening, and a transverse surface (flat here) of the pushing member is visible, being flush or slightly recessed relative to the end 102*b* or 117*b* in the unactuated position. Actuation of the pushing member 111 can be facilitated by a notch 102*c* formed at the upper end 117*b* of the annular connector 117 (FIG. 10A) or respectively the upper end 102*b* of the tube 102 (FIG. 10B).

A slot 130, opposite the notch 102*c*, may permit the outlet of the delivery member 14 to protrude radially outward beyond the outer face defined by the tube 102, or to be flush with this face. Although FIG. 12 shows a slot 130 which is open at its upper end, such a slot 130 may also be placed differently, with no open side. The slot 130 is vertical here and guides the sliding without allowing significant rotation of the pushing member 111. Of course, the annular connector 117 may have an upper end 117*b* that is identical or substantially similar to upper end 102*b*, for example having an identical slot 130 for the delivery member 14 and an opposite notch to increase the area of contact between the user's finger and the pushing member 111.

Referring now to FIGS. 1 to 6, we will now more particularly describe the retaining piece 26 and its arrangement in the receiving assembly 26, S for the pump 7.

Referring to FIGS. 1 to 4, the retaining piece 26 extends annularly around the plugging element S and has a lower portion 26*b* provided with a flange 26*c* in contact with the ring 24, and preferably engaging with the inner surface S1 of the ring 24 so as to be axially integral with the ring 24. The retaining piece 26 extends longitudinally around the channel L from the lower portion 26*b* to a tubular upper end portion 26*d*, engaging with the external flange 21 formed on the metering pump 7. The external flange 21 may bear against the upper face of the retaining relief or reliefs 261 (FIG. 4), which holds the pump 7 in place.

Figure 4:
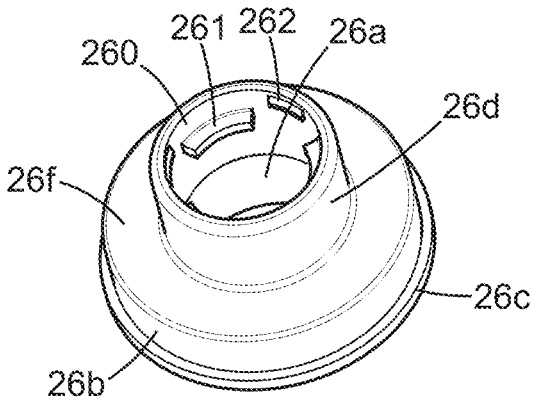
FIG. 4 shows a perspective view of an exemplary retaining piece usable in the stationary portion of the metering assembly and contributing to the axial retention of the metering pump in a housing defined by the plugging element.

As is clearly visible in FIG. 4, the retaining piece 26 may be formed by a piece with transition sections between the lower portion 26*b*, wider than the upper end 4*a* of the container 4, and the upper end portion 26*d*, narrower than the upper end 4*a* and provided with an inner face 260 from which retaining reliefs 261, 262 project radially inward to engage axially on either side of the flange 21. It is thus possible to provide three coaxial parts which extend in succession around the metering pump: the plugging element S, the retaining piece 26, and the ring 24 which is connected to the body 2, with the characteristic that the upper end 4*a* the container 4 is inserted between the lower portion 26*b* and the insertion portion IP of the plugging element S.

More generally, it can be seen in FIG. 3 that the plugging element S defines with the retaining piece 26 a narrow annular groove 50 (which is part of the head 1*b*), into which the axial support edge 38 of the upper end 4*a* is inserted. The upper end 4*a* may fit snugly into this annular groove 50, for example with a contact shaped by the lower portion 26*b*.

Figure 6:
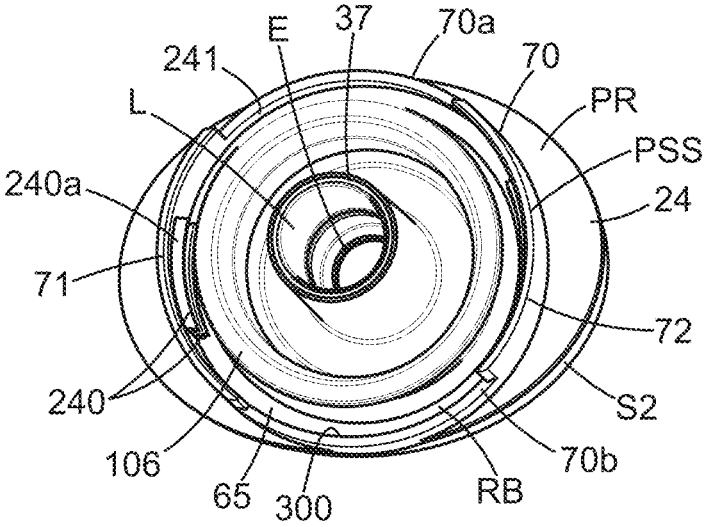
FIG. 6 shows a perspective view of the relative arrangement between the plugging element which houses the metering pump and the ring of the reservoir portion, with a view of the intervening space provided for the upper end of the container and for the lower portion of the retaining piece.

In the case of FIGS. 1 and 6, one can see that the retaining piece 26 engages with the pump 7 on the internal reliefs 261, 262 which may be defined by two pairs of lugs. The flange 26*c* here engages between two lugs of the same pair, locking it axially. Due to the bearing of the container 4 against the inner flange RB of the ring 24 and the axial retention of the retaining piece 26 by the reliefs 240, the container 4 cannot come apart accidentally. Although FIGS. 4-5 show a continuous flange 26*c*, it is understood that such a flange may also be slotted and consist of discontinuous segments.

As illustrated in FIGS. 3 and 4, the retaining piece 26 has an inner skirt 26*a* which defines, with the lower portion 26*b*, an annular groove 26*g*. The region with the flange 106 of the insertable plug portion 105 can be housed in this annular groove 26*g* during handling and transportation of the head 1*b* (as can be seen at the top of FIG. 2), until final assembly after filling.

The surface of the plugging element S serving to define the first annular area of contact 27 extends inside the annular groove 26*g*. In other words, opposite to the upper end portion 26*d*, the sealing surface can be protected by its positioning in such a groove 26*g*. After final assembly, the inner face 104 also extends into the groove 26*g*, so that a secure sealed connection is obtained, formed between the upper end 4*a* of the container 4 and the insertion portion IP extended by the flange 106. Here, the inner skirt 26*a* extends from the radial portion 26*f* that defines the transition section, to an annular end positioned lower than the first annular area of contact 27.

As is clearly visible in FIGS. 1, 3, 9, 10A-10B, it is understood that the contact between the upper end 4*a* (without any O-ring) of the container 4 and the metering assembly 15 (also without any O-ring) is direct, without the need for an additional gasket.

FIG. 5 shows a group of four parts for assembly 11, 17, 26 and S (here not including the optional cap 16) in order to surround the metering pump 7. The pushing member 11 is formed of a rigid part and is guided in its sliding by the pump body 7*c*. The tubular wall 11*b* may also optionally be angularly guided by the outer guide surface 18*b*, cylindrical or some other suitable shape, defined by the annular connector 17. The annular connector 17, preferably formed as one piece, here has an upper sleeve 18 which defines the outer guide surface 18*b* and an inner surface 18*a* (the inner surface is cylindrical and relatively narrow here but alternatively the annular connector 17 may have a different configuration, for example with a retaining function for the pushing member 11 to make it non-detachable).

The body 7*c* of the pump 7 defines the insertion portion 12 which is inserted into the receiving assembly formed by the plugging element S and the retaining piece 26. While the flange 21 may be in axial contact on the top of the channel L, the insertion portion 12 defines for example a sealing radial contact against the channel L.

A constriction E which defines an outlet of the channel L (at the volume V) may form an annular bearing surface for a shoulder 12*a* of the insertion portion 12 which is formed near the inlet 7*a*. The annular lip 23, conical here, together with this constriction E, forms a seal with the bottom of the pump 7.

As shown in FIGS. 1 and 3 in particular, the inner surface 18*a* allows the annular connector 17 to be positioned around the upper end portion 26*d*, and more generally around the metering assembly 15, prior to engaging the annular connector 17 on the body 2. It is possible for the annular connector 17 not to clamp the receiving assembly 26, S or the ring 24, so that rotational force on the annular connector 17 (relative rotation about the longitudinal axis X in relation to the reservoir portion 1*b*) will not be passed on to these internal parts.

The annular connector 17 is positioned for example by simple axial pressure on the radial portion 26*f*, with no centering function. The alignment between the container 4 and the head 1*b* is achieved in the area of contact between the flared inner surface 104 (typically forming a conical sealing seat) and the plugging element S. The configuration of the end piece 6, with the retaining piece 26 which covers the plugging element S, frees this area of contact from any kind of parasitic stress that would affect the uniform distribution of the radial compression of the plugging element S on the conical seat of the container 4.

In the example of FIGS. 3 and 5, one can see that the annular connector 17 has a peripheral portion that extends longitudinally in an annular manner from the outer edge 20*a* of the radial portion 20, forming an outer skirt 19 which forms part of the external decorative packaging of the device 1. An annular transition portion 190 which extends from the outer edge 20*b* to an annular outer shoulder, allows connecting the skirt 19 to the radial portion 20. An attachment surface 19*a* for the cap 16, for example in the form of a peripheral groove, is defined on the outer side of the transition portion 190. One can see internal ribs 161, 162 of the cap 16 in FIG. 3, forming engagement members which engage with the attachment surface 19*a*. The attachment surface 19*a* may define for example a peripheral groove which engages with a bead of the cap 16 or isolated projections defined by the internal ribs 161, 162.

It is understood that the metering pump 7 is in a central position relative to the annular connector 17, with no contact between the body 7*c* of the pump 7 or the stem 11*a* and the annular connector 17. The retaining piece 26 forms an intermediate layer, which can limit the transmission of stresses caused by external impacts and thus can play a protective role for the functional components such as the container 4, the plugging element S, or the metering pump 7.

To keep the annular connector 17 integral with the body 2, there is provided an inner assembly face 19*b*, on the inner side of the skirt 19. The inner assembly face 19*b* is connected to an annular edge 2*c* of the body 2 located in an annular upper face 40 and/or on the outside of the side wall 2*b* (near the annular edge 2*c*).

Figure 8:
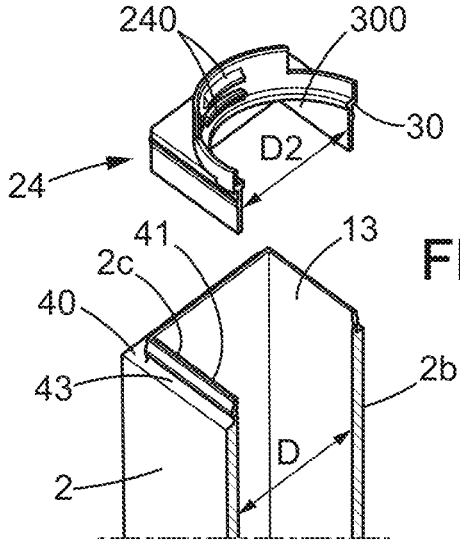
FIG. 8 illustrates axial sectional views of a mode of mounting a ring in a body of substantially rectangular cross-section, according to an alternative embodiment.

In the example illustrated in FIGS. 3 and 7-8, the body 2 has an upper annular face 40 (whose perimeter is noncircular here) from which an annular projection 41 extends to a support edge 42. The inner assembly face 19*b* is positioned around the annular projection and the skirt 19 comes to rest on the outer shoulder 43 defined by the annular upper face 40 around the annular projection 41. The ring 24 can also come into contact with the support edge 42 and engage, by its peripheral face S2, with the projection 41. Here the area of contact with the container 4 defined by the ring 24 is divided into an axial annular contact (from above, in a contact plane) and a typically cylindrical radial annular contact (from inside), as the area of contact defined by the container 4 with the plugging element S.

To minimize movement of the container 4 of circular cross-section with respect to the body 2 (which typically has a non-circular cross-section), the following may be provided on the annular projection 41:

- at least one first retaining relief R1, on the inner side in contact with the skirt 25 of the ring 24 (the one or more retaining reliefs R1 are particularly advantageous for pre-assembly of the lower reservoir portion 1*a* shown in FIGS. 1-2); and
- at least one second retaining relief R2 on the outer face in contact with the skirt 19 (the one or more retaining reliefs R2 are particularly advantageous for obtaining a final durable assembly between the two sub-assemblies shown in FIG. 2).

In the mounted state with the head 1*b* on the reservoir portion 1*a*, as shown in FIG. 3, the first relief R1 (here forming a peripheral groove) and the support edge 42 form abutments B1, B30 that are of different orientation, typically opposite, to lock the ring 24 axially relative to the body 2.

Similarly, the second relief R2 (here forming an annular outward protrusion) and the external shoulder 43 form abutments B2, B43 that are of different orientation, and preferably opposite, to lock the annular connector 17 axially relative to the body 2. With the abovementioned reliefs R1, R2 and abutments, it is possible to sandwich the annular edge 2*c* between the ring 24 and the annular connector 17. The annular connector 17 thus remains secured to the reservoir portion 1*a* during use of the device 1, which allows using this annular connector 17 as a support for a cap 16. Moreover, the skirt 19 of the annular connector 17 can axially extend the outer face of the body 2 with a perimeter of identical length and form (with continuity of the surface).

The anchoring of the annular connector 17 to the body 2 can be used to supplement, or optionally eliminate, the retention of the retaining piece 26 by the ring 24. However, as illustrated in FIG. 6, it is preferable that the ring 24 alone performs the axial stop function for the container 4. The axial retaining function by the reliefs 240 corresponds to a temporary retention of the container 4 in the body 2 (retained during handling operations in the production cycle, before final assembly). To avoid structurally compromising the upper relief of a pair of reliefs 240 during assembly operations, it may have a beveled upper face 240*a*. A beveled upper face may also be provided for the retaining relief or reliefs 262 which prevent withdrawing the pump 7 from the receiving assembly 26, S.

When the body 2 and the annular connector 17 have a corresponding non-circular cross-section, a guiding and centering effect of the annular connector 17 is provided by the annular projection 41. This can optionally extend into the longitudinal extension of the inner face of the body 2, such that the skirt 25, of cylindrical shape, can extend lower than the projection 41. This stiffens the attachment with the body 2. It is understood that the assembly shown is of the non-detachable type.

One will note that the peripheral portion of the annular connector 17 covers the ring 24. While the body 2 defines a first decorative periphery, the head 1*b* comprising the annular connector 17 defines a second decorative periphery that may axially extend the first periphery, preferably with cross-sectional continuity between the reservoir portion 1*a* and the head 1*b*. Here, it is understood that the body 2, the annular connector 17, and the cap 16 give the device 1 its external shape, as is clearly visible in FIGS. 1 and 9.

In this non-limiting example, the ring 24 does not extend radially beyond the annular projection 41. The radial portion PR may cover all or part of the supporting edge 42 without interfering with the skirt 19, and more generally without being part of the visible periphery of the device 1. In less preferred variants, the annular connector 17 may be designed without the skirt 19 and is attached to the ring 24 while providing covering above the area of interconnection between the receiving assembly 26, S, and the ring 24.

In options without the annular connector 17 or skirt 19 for such an annular connector 17, the cap 16 can be engaged on the body 2. In this case, it is also possible that the ring 24 is not visible, at least when the cap 16 is engaged on the body 2.

Referring to FIG. 7, in the preferred case of a circular cross-section of the container 4, the filling opening O has a diameter D2 which may be substantially identical to the diameter D1 of the container 4 at its lower end 4*c*, preferably less than D1, and preferably at least 90% or even 98% or 100% of D1. The use of a neckless container 4 allows not slowing down the filling operation. The diameter of the filling opening O is typically greater than 15 mm and generally is more than half the diameter D or similar smallest dimension (width in the case of a rectangle as shown in FIG. 8) representative of the outer periphery of the body 2. More generally, the filling opening O may have a diameter at least equal to 75% of the diameter of the opening 300.

The body 2 and the container 4 may be each made as one piece. The side wall 2*b* of the body 2, which is tubular, may have a constant cross-section as in the case of FIGS. 1 and 7 or may have at least one bulge 60 in an intermediate portion as in the case of FIG. 9. The shape of the cross-section can also vary (for example having an oval cross-section only at a bulge). More generally, the body 2 may have any type of geometry with a circumference suitable for gripping and which exceeds the maximum circumference of the container 4, so as to prevent radial contact between the container 4 and the side wall 2*b*. It is also understood that the ring 24 closes off the upper opening 13 of the body 2 without interfering with the filling opening O.

With particular reference to FIGS. 1 and 7, the bottom 2*a* of the body 2 may comprise a pressure equalization hole 2*d* which opens inwardly, either in a lower central area without product 5, located directly below the container 4, or in a peripheral volume VP surrounding the container 4. More generally, an air intake system can be formed in any suitable shape at the bottom 2*a*, preferably maintaining a distance from the side wall 2*b*. The support base B may correspond to at least one lower bearing surface and a base plane P of the body 2 is defined by the lower bearing surface. The pressure equalization hole 2*d* may be offset relative to the lower bearing surface so as to be inset from the base plane P, which reduces the risk of accidentally clogging the hole 2*d*.

The hole 2*d* may alternatively be formed in or between the annular connector 17 and the ring 24. Such positioning outside the body 2 can facilitate and/or improve the design of the body 2 (for example by molding).

The overall height of the wall forming the bottom 2 can be particularly small, with an upper face 2*e* of the bottom 2*a* which is flat but connecting to the side wall 2*b*. The bottom 2*a* may thus have a height h that is less than 2 or 3 mm.

When the body 2 is transparent, the container 4 can be seen. In this case, the container 4 may typically have a cylindrical shape or one that is slightly tapered towards the opening 13, and a piston 29 defines the leaktight and movable wall P4. This is considered more aesthetic than a flexible pouch or similar container 4 with a leaktight and movable wall P4 which retracts due to the flexibility of the material used. Of course, the option with a piston 29 can be used with any category of decorative packaging, provided that the body 2 does not have a neck or a narrower cross-section that reduces the flow area to dimensions smaller than that of the wall 4*b*.

Figure 9:
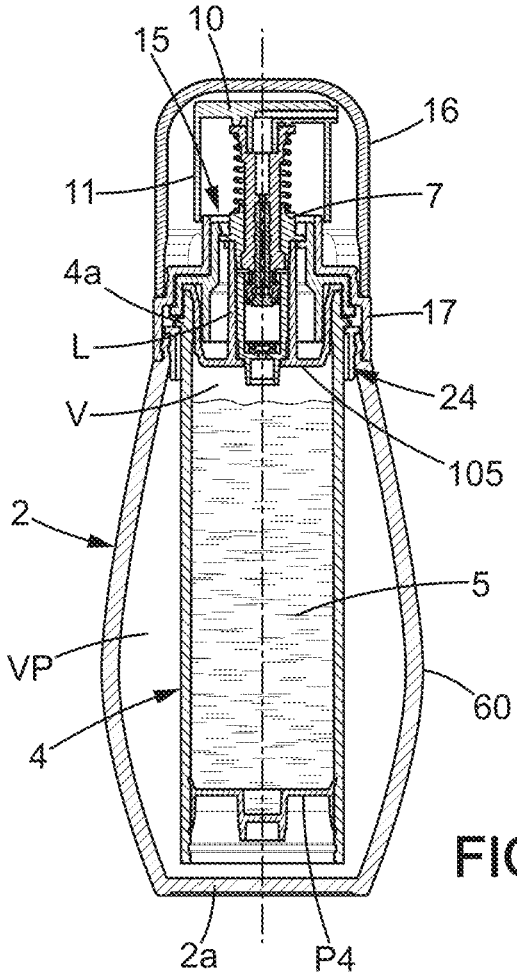
FIG. 9 is a view similar to that of FIG. 1 which illustrates an alternative embodiment with a glass body having a variable cross-section.

As illustrated in FIGS. 1, 7, and 9, the piston 29 has for example a circular cross-section which enables ensuring a good seal. It is therefore understandable that the cross-section of the rigid guiding wall 4*b* is circular. Under the piston 29, it is possible to eliminate the bottom 2*a* or use the hole(s) 2*d* to maintain sufficient pressure against a lower face 29*a* of the piston 29 opposite to the filling opening O for the product 5.

The piston 29 provides a leaktight separation and also maintains an identical pressure between the fluid product 5 contained in the reservoir and the air of the peripheral volume VP. In addition, the contours of the piston 29 may correspond to the lower surface 15*a* defined by the metering assembly 15 which extends into the container 4, as is clearly visible in FIG. 1. In this non-limiting example, the piston 29 defines an internal cavity 29*b*, centrally positioned, for receiving a protruding channel end forming the inlet 7*a* when the piston 29 is raised due to consumption of the product 5. This enables approaching complete delivery of all product 5 (for example about 95% or more of the product is delivered), typically with an elimination or significant reduction of the dead volume.

The dynamic seal formed between the piston 29 and the side wall 4*b* can be implemented with low frictional force of the piston 29, particularly when the product 5 has a high viscosity. Indeed, the force exerted by the user on the pushing member 11 has to overcome the return spring R, the viscosity of the cosmetic product, and the friction of the piston 29. In order to reduce the friction of the piston 29 and minimize the force the user must exert, very high geometric precision of the wall 4*b* of the container 4 (and piston 29) is required if one wishes to ensure a given level of frictional force of the piston while still being leaktight, which prevents giving any decorative function to the container 4 (as decorative functions typically involve heating or mechanical deformations which alter the integrity of the wall 4*b*). A slightly conical geometry of the wall 4*b*, with widening towards the lower end 4*c*, can contribute to facilitating insertion of the piston 29 without damage and to obtaining a satisfactory seal.

Insertion of the piston 29 during assembly can advantageously occur from the bottom, at the lower end 4*c*, which eliminates the need for the piston 29 to travel the entire height of the container 4 to reach its filling position, visible in FIG. 1. With assembly from the bottom, the piston slides in the container 4 over a small distance and it is not damaged by friction along almost entire length of the container 4. This reduces the risk of damage to the piston 29 (good dynamic sealing during use of the device 1).

In an alternative embodiment (not shown), the leaktight and movable wall P4 is formed by a flexible wall or a flexible pouch which can be retracted and/or deformed to reduce the internal volume of the container 4. The wall P4 preferably extends opposite to the end 4*a* which is rigid and which may be identical to what is shown in FIG. 3. With this type of container 4, a pressure equalization hole 2*d* may be provided when the body 2 has a bottom 2*a*. The body 2 may be made of opaque material so that the filled and/or contracted state of the pouch or flexible bag of the container 4 is not visible as the product 5 is gradually consumed.

According to one option, at least the portion of the container 4 which forms the pouch is of flexible and leaktight material (and providing a good level of neutrality to cosmetic or pharmaceutical formulations), for example of polyethylene.

The leaktight and movable wall P4, in the form of a pouch which is moved by contraction, may be advantageous particularly in the following two cases:

- to provide a very high level of protection for the product contained in the container 4, in particular if the latter is susceptible to oxidation; the pouch in this case is defined by a laminate comprising an oxygen barrier material such as a layer of aluminum or EVOH in order to provide better protection than a container 4 with a piston (high protection due to the fact that this eliminates the natural permeability of polyolefins used in thicknesses of around a millimeter and because this eliminates the chance of infiltration between the piston 29 and the fixed wall).
- when the outer body 2 is nowhere near cylindrical in shape, because the pouch adopts the internal shape of the body 2 and thus minimizes the wasted space; this optimizes the ratio between the volume of content and the overall size of the device 1.

To maintain an impact-resistant interconnection, it is preferable that the container 4, having a movable or flexible and retractable wall P4, be inserted from the top and through the opening 300 of the ring 24, bearing axially on the inner flange RB. However, alternatively, the container 4 can be mounted with insertion of the rigid upper end 4*a*, from below the ring 24, for example by using a bayonet-type connection in the inner surface 241, which opposes an inward displacement of the container 4 during assembly of the head 1*b* onto the reservoir portion 1*a*.

Preferably, the ring 24 has a skirt 25 which internally covers the upper end of the inner face f1 of the side wall 2*b* of the body 2. The ring 24 may have an annular outer flange 30 which covers the annular edge 2*c*. In this case, the ring 24 has for example an annular shoulder 24*a* adjacent to the skirt 25, which engages the annular edge 2*c* (by the support edge 42). The shoulder 24*a* can be narrow so that the annular outer flange 30 does not project radially outward relative to the outer face f2 of the side wall.

The ring 24 has a radial extension which varies to match the periphery of the annular edge 2*c*, as is clearly visible in FIGS. 7 and 8 for example. The radial extension is defined by the disk-shaped and substantially flat radial portion PR, which is defined internally by the inner flange RB and externally by the outer flange 30. The skirt 25, which extends downward from the lower face of portion PR, has a minimum height that is typically greater than that of the annular projection 41.

The protruding upper portion PSS of the ring 24, which extends longitudinally toward the head 1*b* from the upper face DP of the radial portion PR, has a minimum height which is optionally less than the height of the skirt 25 in the option illustrated in the figures, with reductions in height in this non-limiting option in the circular sector or sectors where the radial extension of the ring 24 is shorter. Two opposite regions Z1, Z2 of the projecting upper portion PSS are thus locally shorter in the case of a rectangular or oval cross-section of the body 2. This allows the annular connector 17 to have a transition portion 190 of the same size as the outer skirt 19 and ensures optimum guidance of the cap 16.

Referring to FIGS. 2 and 6, one can see that the combination of a ring 24 and a plugging element which passes through the opening 300 of the ring in order to close the filling opening O, makes it possible to position the connection contacts in one narrow annular space 65.

Indeed, the upper end 4*a* of the container 4 occupies the lower portion of this annular space 65 and is received under flange 106, while the lower portion 26*b* of the retaining piece 26 externally covers the upper end 4*a* in this annular space 65. Flange 26*c*, shown in FIG. 4, engages between the reliefs 240 which are superimposed above the region for engaging the annular bead 400. Under each pair of reliefs 240, there is at least one groove for receiving the bead 400.

The upper portion PPS of the ring 24 is here formed by a ring portion 70 having two notches 70*a*, 70*b* or slits. The reliefs 240 are formed on the inner side in the tabs 71, 72 defined between the notches 70*a*, 70*b*. Of course, the ring 24 may have a different number of reliefs 240 and/or a different distribution of these reliefs 240 on the inner face S1. It is understood that the reliefs 240 are radially further from the central axis X than the inner edge of the flange RB in the example shown, so as not to interfere with the passage of the container 4 through the opening 300.

To assemble the reservoir portion 1 shown at the bottom of FIG. 2, the container 4 is inserted into the internal volume of the body 2 while supporting it with the ring 24 (itself temporarily clipped into the body 2 via the lug, bead, or similar reliefs which form the abutment B1). For the reservoir portion 1*a* only it is thus understood that a provisional non-rigid assembly is carried out in order to hold the pieces in place until final assembly. FIG. 7 illustrates an example assembly of the reservoir portion 1*a* when the body 2 has an ovoid perimeter. A triangular perimeter with rounded corners or a rectangular perimeter with rounded corners (see FIG. 8) are alternative embodiments which are cited here among a plurality of variants for the outer decorative packaging.

For the assembly of the head 1*b* shown at the top of FIG. 2, we can combine the receiving assembly 26, S or similar stationary portion with no movable parts and the metering pump 7 which here is topped by a movable actuating portion 10 which moves the stem 11*a* and thereby controls the dispensing of the fluid product 5. Seen from below, the receiving assembly 26, S and cap 16 cover the metering pump 7, with the exception of the narrow inlet 7*a* which does not extend more than one cm beyond the level defined by the lower face (in this example defined by the radial portion PR) of the plugging element S.

The final stage of assembly, after filling with product 5, is achieved by connecting the plugging element S to the upper end 4*a* of the container 4, with the feature of the metering assembly 15 not being in contact with the body 2 defining the decorative periphery of the reservoir portion 1*a*.

While the body 2 (and possibly the ring 24 in less preferred options) allow defining a decorative packaging for the reservoir portion 1*a* of the device 1, the annular connector 17 and the cap 16 allow defining a decorative packaging for the head 1*b* of the device 1.

To be able to produce different types of decorative packaging without complicating the steps of assembly, the connection between the reservoir portion 1*a* and the head 1*b* is advantageously made between the plugging element S and the first end 4*a* of the container 4. The connection which establishes continuity between the decorative packaging components is therefore separate and independent from the leaktight connection region for plugging the filling opening O.

The device 1 can be compact and is well-suited for dispensing very precise doses of liquid or viscous product. The device is typically in the form of a bottle and is designed in particular for cosmetic applications and other applications requiring a high degree of personalization of the bottle.

The device 1 is particularly suitable with an airless metering pump 7 which reduces the risk of contamination while enabling an almost complete emptying of product 5. It is also understood that the device 1 has a very limited number of movable or flexible parts, so it is particularly robust and remains effective after many uses. Integrity around the container 4 and pump 7 is maintained despite any impacts, which guarantees a leaktight seal.

In addition, there is no limitation on the possibilities for the external shape and decorative packaging of the device 1, due to the functional parts being kept away from the body 2 and other external elements 16, 17 of the device 1. Thus, the body 2 may have a non-circular cross-section and be particularly well-suited for the transportation and storage requirements of the devices 1. For example, the shape of the body 2 can be adjusted in order to reduce or eliminate dead spaces between bottles and to have a wide range of options for making products stand out on the shelves.

In the illustrated examples, it is understood that the container 4 and the dispensing head 1*b* can form an integral subassembly that can be installed (as one piece) in a body 2 serving as decorative packaging. The user can therefore optionally separate this sub-assembly from the external decorative packaging in order to refill the device 1 (replace an empty cartridge with a full one). This allows reusing the body 2 of the decorative packaging multiple times, as it may be elaborately decorated and relatively expensive, and thus prolonging its service life beyond the time required to use up the product 5 contained in the container 4.

In such a case, it may be advantageous for the body 2 not to have a bottom, or to have a removable bottom 2*a*.

In alternative embodiments, the body 2 does not necessarily define a base B below the container 4, and there is no bottom 2*a*.

Figure 13:
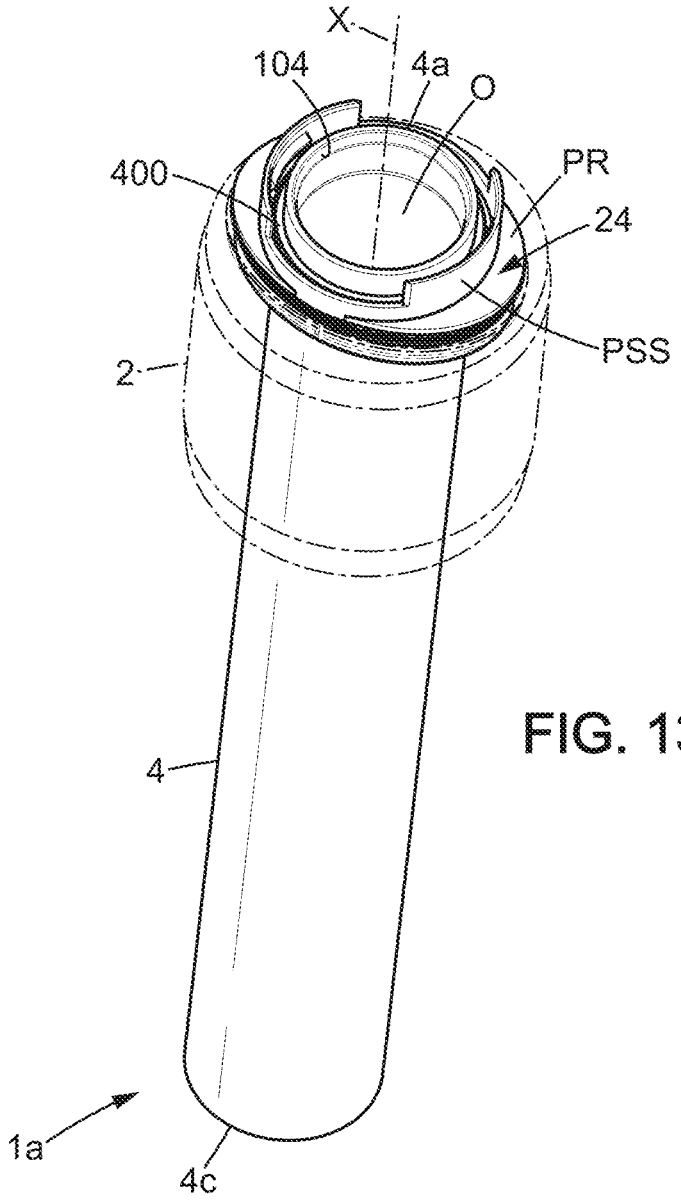
FIG. 13 is a view similar to the lower part of FIG. 2, illustrating the case of a body that is significantly shorter than the container in order to define a partial peripheral decorative packaging.

Thus, referring to FIG. 13, the body 2 may have a ring shape or similar annular shape that is significantly shorter than the height of the container 4. The container 4 extends into the internal volume defined by the annular body 2 and projects downward beyond the lower edge of the body 2. With such partial peripheral decorative packaging, it is possible to concentrate the added value in a part of reduced size (and therefore cost). The body 2 may be attached in a permanent or removable manner. In the illustrated example, the mode of assembly may be identical or similar to what is shown in FIGS. 3 and 6. Of course, the body 2 may extend upward in the manner of the embodiment described in FIG. 12, in order to extend around the end piece 6.

In another variant (not shown), the body 2 has no bottom 2*a* and laterally covers, at least partially, a subassembly (container 4 and end piece 6) configured so that actuation takes place opposite from the dispensing head 1*b*. It is then understood that the pushing member 11 is eliminated and the actuating area is located opposite the head 1*b* (at the bottom of the container or on a part connected thereto).

It should be obvious to those skilled in the art that the present invention allows embodiments in many other specific forms without departing from the scope of the invention as claimed.

Thus, although the figures show a container 4 made as one piece, one can just as well insert a container with a removable bottom into the body 2. Such a bottom may for example allow mounting the wall P4 from the bottom and can serve to cover and protect the wall P4. Similarly, the retaining piece 26 may be replaced by an equivalent assembly of at least two parts having both an effect of axial thrust on the plugging element S and of retaining the pump 7.

The invention claimed is:

1. A device for packaging and dispensing a fluid product, the device comprising:

a body which is hollow and is provided with a bottom or a lower edge;

a reservoir portion which comprises a container defining a reservoir and extending at least partially into an internal volume of the body, the container having an upper end of tubular shape provided with a filling opening;

a head comprising an airless-type metering assembly, the metering assembly comprising a metering pump, a plugging element which is part of a stationary portion of the metering assembly, and an actuating portion which is movable to allow dispensing the fluid product, the plugging element extending around the metering pump and forming a lower face of the head, the plugging element being separate from the metering pump and forming a support part for the metering pump, the plugging element being directly connected to the upper end of the container in order to seal the filling opening; and a connection interface, formed in the reservoir portion and distinct from the body, for connecting in a leaktight manner the metering assembly of the head to the reservoir of the reservoir portion, the metering pump comprising an inlet which extends to one end of the reservoir that is opposite to the bottom or lower edge when the head is mounted on the reservoir portion;

wherein the reservoir portion further comprises a ring of annular shape that is separate from the body and the container, configured to integrally secure the body and the container by extending between an inner surface engaged against the upper end of the container and a peripheral attachment surface for the body, and wherein the connection interface comprises the upper end of the container to engage with the plugging element and define a radial annular sealing contact container plugging element, the container comprising at least one leaktight and movable wall that is movable towards said inlet in order to compensate for any negative pressure in the reservoir.

2. The device according to claim 1, wherein the plugging element comprises an insertable plug portion in annular radial sealing contact with an inner face of the upper end, so that the upper end and the plugging element are connected by fitting them together in a leaktight manner.

3. The device according to claim 2, wherein the insertable plug portion comprises an insertion portion of cylindrical cross-section inserted through the upper end of the container and through an opening in the ring and coaxial with a central channel for accommodating and supporting the metering pump.

4. The device for packaging and dispensing according to claim 2, wherein the stationary portion comprises a retaining piece which is more rigid than the plugging element and which extends annularly around the plugging element, the retaining piece being configured to be engaged with the ring, so that the plugging element is held clamped between the upper end of the container and the retaining piece.

5. The device according to claim 4, wherein the plugging element, formed as one piece, comprises a flange adjacent to the insertable plug portion, the flange being caught between the retaining piece and an axial support edge of the upper end adjacent to the inner face.

6. The device according to claim 4, wherein the retaining piece is made of a first rigid material, while the plugging element is made of a second material that is more flexible than the first material.

7. The device according to claim 1, wherein the body is constructed as one piece and has an upper opening, the ring closing off the upper opening without interfering with the filling opening.

8. The device according to claim 1, wherein the container has a circular cross-section, at least at the upper end, the ring defining a circular opening for inserting the container into an internal volume of the body.

9. The device according to claim 1, wherein the body defines a first decorative periphery, the head having an annular connector integral to said stationary portion and which surrounds the metering assembly to define a second decorative periphery.

10. The device according to claim 9, wherein the head further comprises a removable cap, fixed to the annular connector in a storage configuration, and wherein the body, the annular connector, and the cap define an external form of the device in the storage configuration.

11. The device according to claim 9, wherein the body has an annular upper face from which an annular projection extends to a support edge, an external shoulder surrounding the annular projection being provided in the annular upper face, the annular connector extending around the annular projection and abutting against the external shoulder.

12. The device according to claim 11, wherein the annular projection has:

an inner face provided with at least one first retaining relief; and an outer face provided with at least one second retaining relief, wherein, when the head is mounted on the reservoir portion, said first relief and the support edge form abutments of different orientation to lock the ring axially relative to the body, while said second relief (R2) and the external shoulder form abutments of different orientation to lock the annular connector axially relative to the body.

13. The device according to claim 1, wherein the body comprises a bottom which comprises:

at least one lower bearing surface which defines a base plane of the body; and a pressure equalization hole which is offset relative to the lower bearing surface such that the pressure equalization hole is inset from the base plane.

14. The device according to claim 1, wherein the body comprises a one-piece tube defining a single lateral decorative periphery around the container and the metering assembly.

15. The device according to claim 1, wherein the stationary portion comprises a retaining piece that extends annularly around the plugging element and has a lower portion in contact with the ring, so as to be axially integral with the ring, the retaining piece extending longitudinally from the lower portion to an upper end portion in engagement with an external flange formed on the metering pump.

16. The device according to claim 15, wherein the plugging element defines with the retaining piece an annular groove that is part of the head, the upper end defining an axial support edge inserted into the annular groove when the head is mounted on the reservoir portion.

17. The device according to claim 15, wherein the retaining piece has an inner skirt which defines with said lower portion a determined annular groove opposite the upper end portion, the plugging element and the upper end of the container being in annular sealing contact with one another within the determined annular groove when the head is mounted on the reservoir portion.

18. The device according to claim 1, wherein the inner surface of the ring has an inner flange of annular shape, in axial contact from below with a collar or collar portions of the container, at said upper end.

19. The device according to claim 1, wherein the ring comprises a flat radial portion extending between an inner flange and an annular outer flange, the inner flange defining an opening of the ring which is located above an internal volume of the body.

20. The device according to claim 19, wherein the ring further comprises:

a continuous or segmented skirt extending longitudinally towards the bottom from a lower face of the radial portion, the peripheral surface for attachment to the body being defined by the skirt and by the underside of the annular outer flange; and a protruding upper portion extending longitudinally about a longitudinal axis of the container from an upper face of the radial portion, internal reliefs being formed on the protruding upper portion, projecting radially inward and facing the upper end of the container so as to engage with a portion of the metering assembly.

21. The device according to claim 1, wherein the container is cylindrical and extends around a longitudinal axis, the leaktight and movable wall being formed by a piston that is movable in translation along the longitudinal axis.

22. The device according to claim 1, wherein the container has a side wall adapted for guiding a piston, the side wall having a circular cross-section that widens towards a lower end of the container and extending as far as an opening for mounting the piston in the container.

23. The device according to claim 1, wherein the leaktight and movable wall is formed by a retractable flexible portion, the upper end of the container forming a rigid connector.

24. An assembly method for obtaining a device for packaging and dispensing a fluid product as recited in claim 1, from a reservoir portion and a head, wherein the fluid product is introduced through a filling opening, before a final step of mounting the head on the reservoir portion, into a container that is part of the reservoir portion, the method comprising:

combining, in an airless type of metering assembly:

a stationary portion provided with a plugging element which forms a lower face of the head, and a metering pump connected to an actuating portion that is movable and intended for controlling the dispensing of fluid product in response to an action on the actuating portion, so that the plugging element surrounds the metering pump, the plugging element being separate from the metering pump and forming a support part for the metering pump;

inserting the container through an opening formed by an annular ring and mounting the ring in a body which is hollow and defines a decorative periphery around the reservoir portion, so that all or part of the container is held in the internal volume of the body while the ring extends around the filling opening opposite to a bottom or lower edge of the body;

wherein the body and the container are rendered integral with one another by:

i) engaging, against the body, a peripheral surface for attachment to the body formed at a periphery of the ring; and ii) engaging an inner surface of the ring against the upper end of the container;

the container defining said filling opening and comprising at least one leaktight and movable wall that is movable towards said inlet in order to compensate for any negative pressure in the reservoir;

and wherein the final assembly step is carried out by connecting the plugging element to the upper end of the container in order to seal the filling opening, defining a radial annular sealing contact directly between an inner face of the container and the plugging element.

* * * * *